US008001940B2

(12) United States Patent
Sailer et al.

(10) Patent No.: US 8,001,940 B2
(45) Date of Patent: Aug. 23, 2011

(54) SWITCHABLE BUCKET TAPPET

(75) Inventors: Peter Sailer, Erlangen (DE); Mario Kuhl, Herzogenaurach (DE); Lucia Hinkovska, Herzogenaurach (DE); Sandra Schaefer, Hoechstadt (DE)

(73) Assignee: Schaeffler KG, Herzogenaurach (DE)

( * ) Notice: Subject to any disclaimer, the term of this patent is extended or adjusted under 35 U.S.C. 154(b) by 152 days.

(21) Appl. No.: 12/525,476

(22) PCT Filed: Jan. 30, 2008

(86) PCT No.: PCT/EP2008/051102

§ 371 (c)(1),
(2), (4) Date: Jul. 31, 2009

(87) PCT Pub. No.: WO2008/092884

PCT Pub. Date: Aug. 7, 2008

(65) Prior Publication Data

US 2009/0314237 A1 Dec. 24, 2009

(30) Foreign Application Priority Data

Feb. 2, 2007 (DE) ..... 10 2007 005 302

(51) Int. Cl.
*F01L 1/14* (2006.01)

(52) U.S. Cl. ..... 123/90.48; 123/90.5; 123/90.52; 123/90.55

(58) Field of Classification Search ..... 123/90.48, 123/90.52, 90.5, 90.55; 74/567, 569
See application file for complete search history.

(56) References Cited

U.S. PATENT DOCUMENTS

| | | | |
|---|---|---|---|
| 5,603,294 | A | 2/1997 | Kawai |
| 5,934,232 | A | 8/1999 | Greene et al. |
| 2002/0195072 | A1 | 12/2002 | Spath |
| 2003/0075129 | A1 | 4/2003 | Spath |

FOREIGN PATENT DOCUMENTS

| | | | |
|---|---|---|---|
| DE | 34 25 522 | Y | 1/1986 |
| DE | 42 06 166 | Y | 9/1992 |
| DE | 93 06 685 | Y | 6/1993 |
| DE | 43 14 619 | Y | 11/1994 |
| DE | 44 33 742 | Y | 4/1995 |
| DE | 44 36 952 | Y | 4/1996 |
| DE | 44 92 633 | Y | 5/2001 |
| DE | 102 12 327 | Y | 3/2003 |
| DE | 102 04 672 | Y | 8/2003 |
| DE | 102 45 301 | Y | 4/2004 |
| WO | 91/12413 | A | 8/1991 |

*Primary Examiner* — Ching Chang
(74) *Attorney, Agent, or Firm* — Lucas & Mercanti, LLP

(57) ABSTRACT

A switchable bucket tappet for a valve drive of an internal combustion engine, which has a bucket base body with a ring-shaped base guided by a skirt projecting from the outer edge of the base in a bore of the engine. A lifting cam acts on the base and a hollow cylindrical extension projects from an inner edge of the base. In the bore, an inner body is axially movable relative to the bucket base body and, formed in the underside of the inner body, is a support for indirect contact with a gas exchange valve. A coupling piston, which has a flattened portion on its upper side, runs in a bore of the inner body and is engaged with a driver surface for full valve lift. A lost motion spring acts between the bucket base body and inner body.

17 Claims, 3 Drawing Sheets

SWITCHABLE BUCKET TAPPET

This application is a 371 of PCT/EP2008/051102 filed Jan. 30, 2008, which in turn claims the priority of DE 10 2007 005 302.0 filed Feb. 2, 2007 the priority of both applications is hereby claimed and both applications are incorporated by reference

FIELD OF THE INVENTION

The invention relates to a switchable bucket tappet for a valve drive of an internal combustion engine, having a bucket basic body which has a ring-shaped base and which can be guided, by means of its skirt which projects from the outer edge of the base, in a bore of the internal combustion engine, which base can be acted on by at least one lifting cam, with a hollow cylindrical extension projecting from an inner edge of the base, in the bore of which extension runs an inner body which is axially movable relative to the bucket basic body and whose underside has formed in it an abutment for at least indirect contact with the gas exchange valve, with at least one coupling piston running in a bore of the inner body, which coupling piston, in order to obtain a full valve lift, can be placed in engagement in sections with a driver surface of the bucket basic body, and with a lost motion spring acting between the bucket basic body and inner body.

BACKGROUND OF THE INVENTION

A bucket tappet of said type can be gathered from DE 44 92 633 C1, which is regarded as being generic. Said bucket tappet is formed as a switchable bucket tappet whose coupling mechanism is arranged directly below the base. A person skilled in the art will recognize that the already known tappet is of relatively complex design, and the production thereof has therefore proven to be needlessly expensive. For example, the outer part is of asymmetrical design in the base region, since guide bores for the coupling piston are formed below the annular base. It can also be seen that the inner part is of unnecessarily massive design, in particular in the base region. Said massive design is associated with an undesired increase in the oscillating valve drive masses. Furthermore, on account of the piston coupling, relatively high contact pressures can occur in the coupling section, and anti-twist measures are necessary.

OBJECT OF THE INVENTION

It is therefore an object of the invention to create a bucket tappet of the above-mentioned type in which the stated disadvantages are eliminated, which can, in particular, be produced in a cost-effective manner, and which has a simplified coupling mechanism.

ACHIEVEMENT OF THE OBJECT

According to the invention, said object is achieved in that a zero valve lift is obtained when the at least one coupling piston is moved completely into the bore of the inner body, with the inner body being formed, without a base, so as to be entirely free from contact with the cam or base circle, with the at least one coupling piston having, proceeding from its radially outer face, a flattened portion on its upper side, by means of which flattened portion said coupling piston, in the coupled state, can be moved under a flat counterpart surface of the hollow cylindrical extension as a driver surface, which counterpart surface is situated axially below the region of the base of the bucket basic body, which region of the base is of virtually symmetrical and entirely thin-walled design, and with the inner body being formed so as to be freely rotatably movable with respect to the bucket basic body.

The stated disadvantages are hereby eliminated. As a result of the at least substantially symmetrical design without guide bores in the base of the bucket basic body, the production of the latter is simplified and made cheaper, and its mass is reduced. Furthermore, since the switchable bucket tappet is proposed as a disengageable tappet, only at least one large-lift cam is required in the cam region. If appropriate, the measures according to the invention may also be used with bucket tappets whose inner body is provided with a base for making contact with a low-lift or zero-lift cam.

On account of the measures according to the invention having preferably two diametrically oppositely arranged coupling pistons whose coupling region is flattened, secure coupling is provided in the coupled state with only a relatively low contact pressure being expected in the coupling region. In simple terms, the extension, which extends in the direction away from the cam from the inner edge of the base of the bucket base body, for guiding the inner body is used in a suitable manner as a coupling region.

It is also advantageous, in contrast to the shown prior art, that it is possible to dispense with an anti-twist device for preventing rotation of the inner body with respect to the bucket basic body (annular engagement region for the coupling piston).

It is particularly preferable if the inner body is of substantially hollow cylindrical design and is provided with the corresponding radial bore for the coupling piston only by means of an annular web. A further advantage with regard to structural expenditure and costs is obtained since the inner body is not provided with a base region for making contact with a low-lift cam. The inner body may be produced for example by means of extrusion. The massive design of said inner body is however also conceivable, and provided.

In one expedient refinement of the invention, a movement of the pistons in their coupling direction is provided by means of the force of a pressure spring, which pressure spring can act on an inner face of each of the coupling pistons. In contrast, it is proposed that a movement in the decoupling direction be effected by means of hydraulic medium which can be conducted via suitable passages in the skirt. It is however also conceivable, and provided, for the coupling pistons to be moved in their coupling direction hydraulically and for at least one spring to be used in the decoupling direction.

Further subclaims relate to simple measures for setting a coupling or locking play. Accordingly, it is proposed that a pack of securing rings be attached to a cylindrical section, which runs above the annular web, of the inner body, one of which rings, for example, may be provided in a range of different thicknesses in a manner known per se during assembly. A region of the inner edge of the base of the bucket basic body may then abut against an underside of said ring pack. At the same time, this design may also serve as a general travel limiting mechanism and captive retention mechanism.

Instead of the one or two securing rings, it is also possible to provide other radially projecting elements such as pins, balls or the like.

In one expedient physical embodiment of the invention, it is proposed that a material recess such as an annular groove be provided, for example, in the extension of the bucket basic body, which material recess is formed into the bore of said extension and the upper side of which material recess then constitutes the complementary counterpart surface for the preferably two coupling pistons. Said annular groove may then, for example, be formed in a cutting process, though embossing processes or the like are also conceivable.

Alternatively, the coupling pistons may be moved under a lower edge of the extension, such that no annular groove is required here.

As a further alternative, it is proposed that the extension of the bucket basic body be provided with an annular radially widened portion, which may, for example, be formed by means of a production process such as rolling, proceeding from the bore of said extension, with an upper side of said radially widened portion then in turn serving as a complementary counterpart surface for the coupling piston.

Further subclaims relate to measures for conducting hydraulic medium to a point in front of radially outer faces of the coupling pistons in the above-stated coupling variants.

A thin-walled element such as a sheet-metal or plastic part should thus preferably be placed in the interior of the bucket basic body, into which thin-walled element corresponding ducts for conducting hydraulic medium are then formed. Said ducts may be provided so as to be distributed about the circumference in the base region, with a separate axial duct then extending (downward) from each individual duct into the annular chamber in front of the outer faces of the coupling piston.

Since the thin-walled element is arched in the direction away from the base in sections in the base region on account of the radial passages, it is proposed, to provide a "smooth" abutment for the lost motion spring, that an annular part be attached between said spring and an underside of the element.

It is likewise advantageous if at least one ventilation opening leads at least indirectly into the open from the bore for the coupling piston in the inner body. Said ventilation opening may intersect the bore, which is designed preferably as a radial bore, approximately in the region of the center thereof in the manner of a secant. Variants are also conceivable which are continuous in the upward and downward directions, or also embodiments which discharge the air only upward or downward.

Although it is conceivable and provided for the bucket tappet according to the application to be designed to act purely mechanically, that is to say without hydraulic play compensating measures, it may however also be expedient, as proposed in one refinement of the invention, to insert a hydraulic play compensating element of known design in a cylindrical section, which runs below the annular web, of the inner body, the pressure piston of which hydraulic play compensating element then communicates with the at least one gas exchange valve.

Hydraulic medium may again be conducted to the gas exchange valve between the thin-walled element and the bucket basic body through suitable ducts.

It is also advantageous to provide the coupling piston with an anti-twist device such that the flattened portion of said coupling piston is always aligned with the complementary counterpart surface of the extension. Expedient for this purpose are very simple and cost-effective anti-twist measures such as a securing ring fitted on the flattened portions thereof, radially engaging pins, flattened portions on the outer casing or the like.

BRIEF DESCRIPTION OF THE DRAWINGS

The invention is expediently explained in more detail on the basis of the drawing, in which.

DETAILED DESCRIPTION OF THE DRAWINGS

Figure 1:
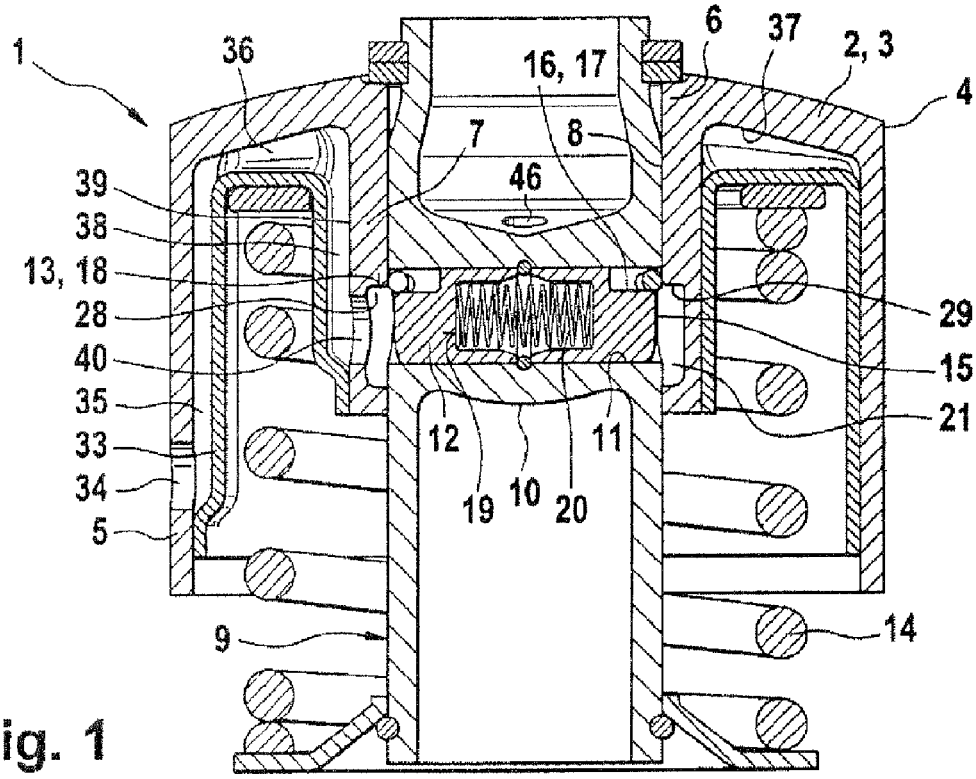
FIG. 1 shows a longitudinal section through a disengageable bucket tappet, having a material recess in the extension thereof for the purpose of coupling.

All the figures illustrate a switchable bucket tappet 1 for a valve drive of an internal combustion engine. Said bucket tappet 1 is designed such that it can be fully disengaged from the cam lift. The bucket tappet 1 is composed of a bucket basic body 3 which is closed off at the cam side by a ring-shaped base 2. A hollow cylindrical skirt 5 projects from an outer edge 4 of the base 2. By means of an outer casing of said skirt 5, the bucket tappet 1 can be arranged in an oscillating fashion in a receptacle (not illustrated in the drawing) of the internal combustion engine.

As can be seen for example from FIG. 1, the base 2 is formed so as to be cylindrically arched in the cam profile direction. Said base 2 expediently comes into contact in a lifting sense with two spaced-apart high-lift cams.

Figure 5:
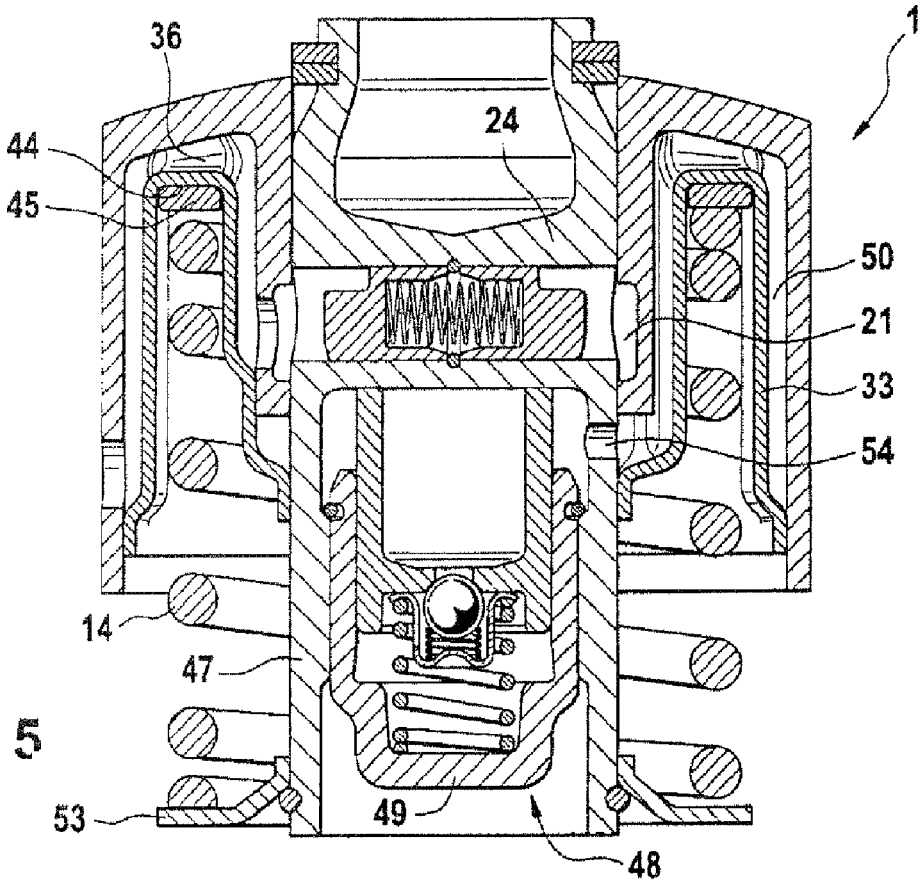
FIG. 5 shows a bucket tappet similar to that illustrated in FIG. 1, but with a hydraulic play compensating element and ducts for supplying hydraulic medium for this purpose in the thin-walled element.
Figure 6:
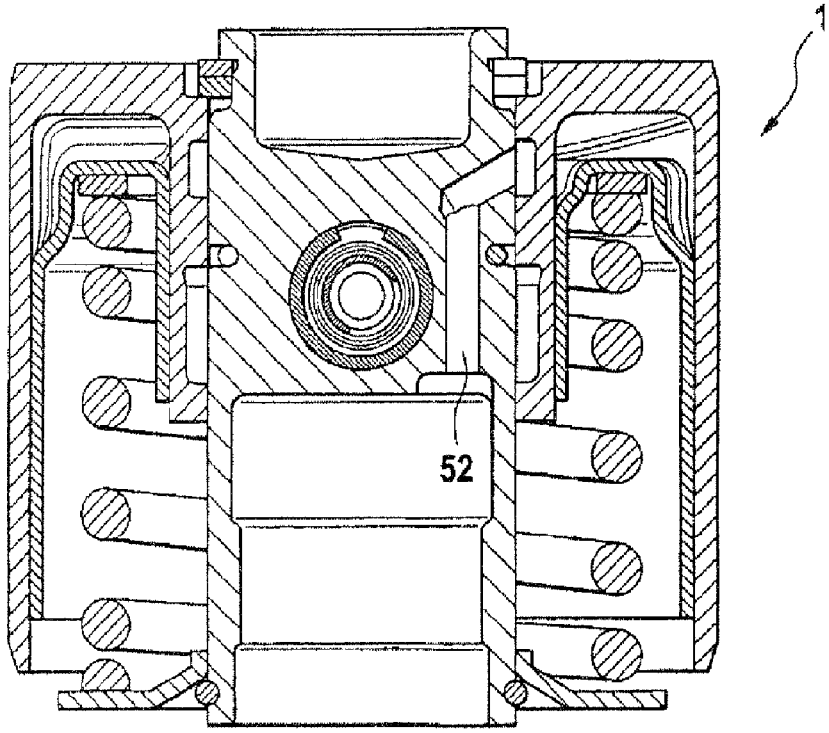
FIG. 6 shows a bucket tappet with alternative measures for conducting hydraulic medium to the hydraulic play compensating element.

A hollow cylindrical extension 7 projects concentrically from an inner edge 6 of the base 2. Said extension 7 has a bore 8 in which runs an inner body 9 as a further essential constituent part of the bucket tappet 1. The inner body 9 is designed so as to be axially movable relative to the bucket basic body 3. The inner body 9 acts with an underside 10 at least indirectly on one or more gas exchange valves in a lifting sense. If a hydraulic play compensating element 48 is installed in the inner body 9, as can be seen in FIG. 5 and as is indicated in FIG. 6, then the inner body 9 acts on the respective gas exchange valve via a pressure piston 49 of the play compensating element 48.

A bore 8 of the extension 7 of the bucket basic body 3 therefore serves as a guide for an outer casing of the inner body 9, which is composed of an upper and a lower cylindrical section 25, 47, which is divided by an annular web 24. It can be seen that the inner body 9 is therefore formed without a base and does not make contact with a cam.

A radially extending bore 11 runs in said annular web 24. Two coupling pistons 12 are situated opposite one another in said bore 11. Said coupling pistons 12 are acted on in their coupling direction by means of the force of one or more springs 20 which act against the inner faces 19 of said coupling pistons 12. A stop ring (not shown) ensures a defined decoupled state of the coupling pistons 12 in the bore 11.

As can be seen, the above-mentioned coupling pistons 12 have, proceeding from their outer faces 15, each one flattened portion 17 on their upper sides 16, on which flattened portions 17 lies a thin-walled annular part as an anti-twist device 51.

All the figures illustrate the decoupled state of the coupling pistons 12 which, when the cam is passing through its base circle, can be placed in engagement with a driver surface 13 of the bucket basic body 3 for the purpose of "connecting through" a full cam lift. A flat counterpart surface 18 in or on the hollow cylindrical extension 7 serves as a driver surface 13.

Figure 2:
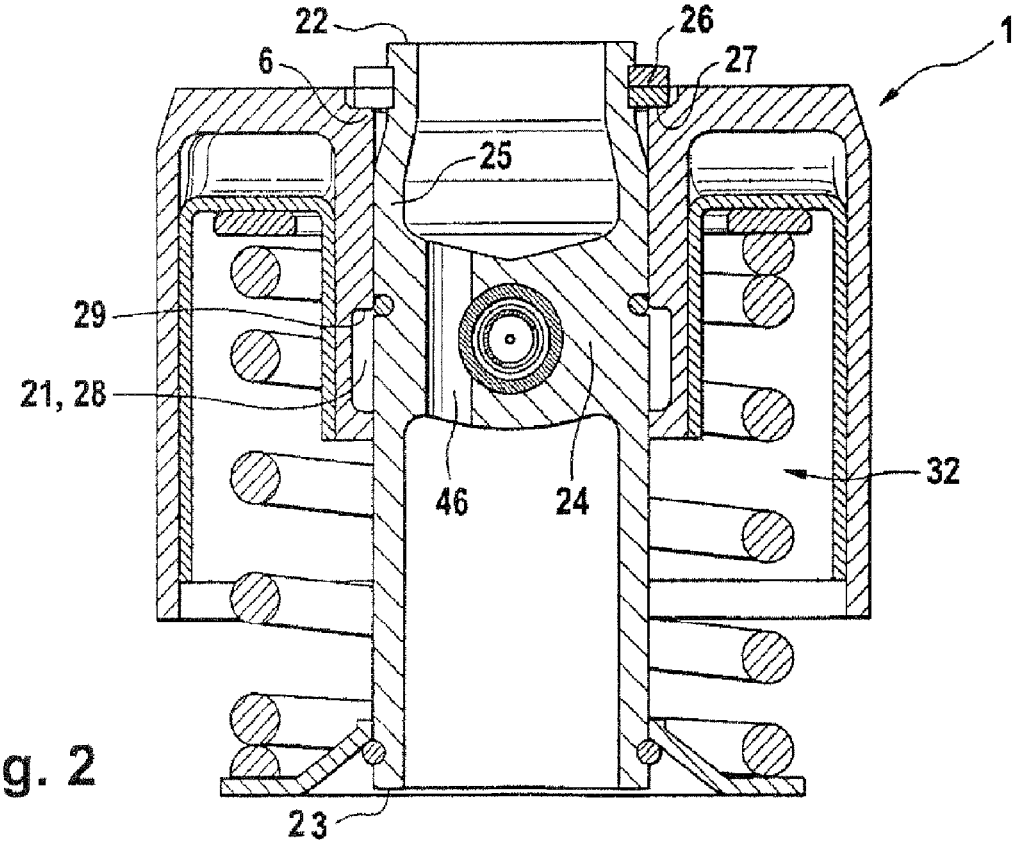
FIG. 2 shows a section, rotated by 90°, according to FIG. 1 showing the ventilation opening.

In the refinement in FIGS. 1 and 2, a material recess 28 is provided in the bore 8 of the extension 7, the upper side 29 of which material recess 28 has the complementary counterpart surface 18. In the case of a plurality of material recesses arranged with stepped heights, it is also conceivable to obtain partial lifts.

Figure 3:
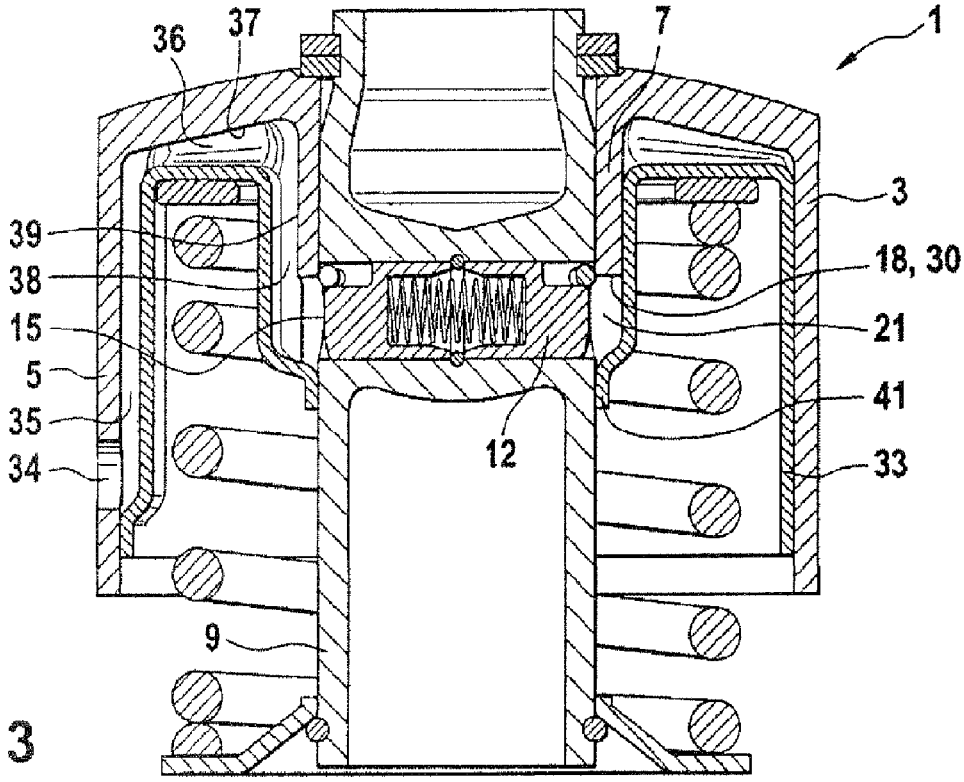
FIG. 3 shows a section as per FIG. 1, in which a lower edge of the extension is used as a counterpart surface for the purpose of coupling.

In the refinement in FIG. 3, a lower edge 30 of the extension 7 is formed as a complementary counterpart surface 18. The coupling pistons 12 preferably move completely under the extension 7 in the coupled state.

Figure 4:
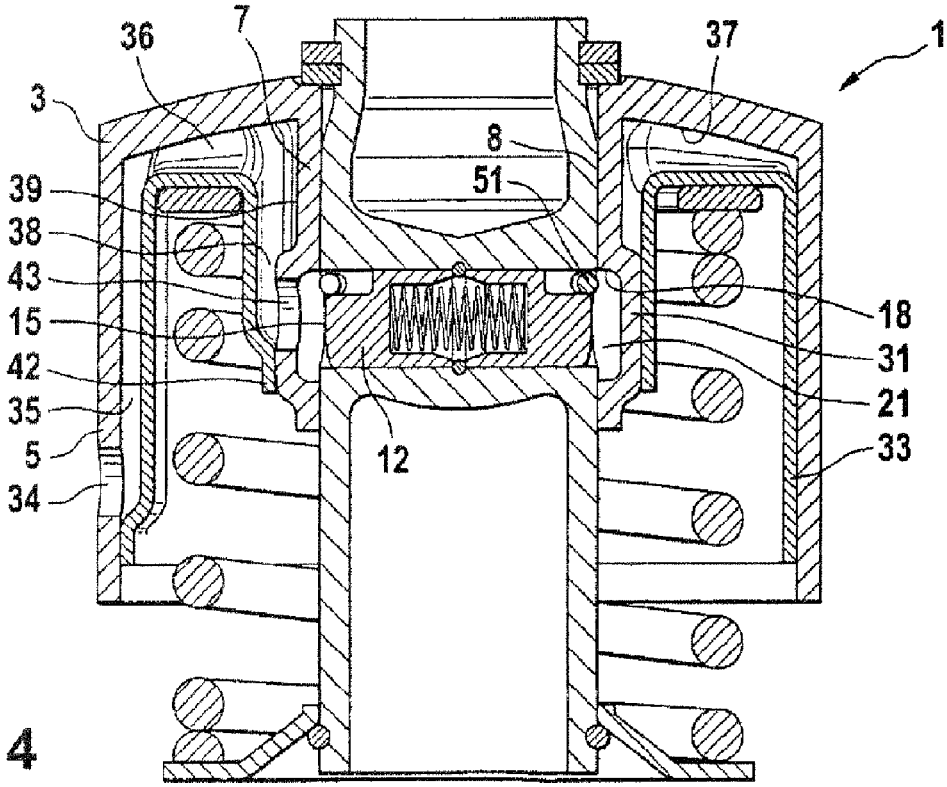
FIG. 4 shows a section as above, but with a radially widened portion in the extension as a counterpart surface.

FIG. 4 shows a refinement similar to the solution disclosed in FIGS. 1 and 2, but with a radially widened portion 31 having been formed in the extension 7 here. Said radially widened portion 31 may for example be formed by means of a production process such as rolling, milling or the like.

In order to supply hydraulic medium to a point in front of the outer faces 15 of the coupling pistons 12, a thin-walled element 33 such as a sheet-metal part is inserted in the interior 32 of the bucket basic body 3. Said thin-walled element 33 substantially follows an inner contour of the skirt 5, of the base 2 and an outer casing 39 of the extension 7. An aperture 34 such as a bore is formed in a lower region of the skirt 5. In the region of said aperture 34, the element 33 has formed in it at least one rising duct 35 which, below the base 2, passes into at least one radial passage 36 in the element 33 (a plurality of circumferentially distributed radial passages 36 are preferably provided).

On the side of the extension 7, the at least one radial passage 36 communicates with an axial duct 38 which is likewise formed in the element 33. Said axial duct 38 leads axially downward to an annular chamber 21 in front of the faces 15 of the coupling pistons 12. It can also be seen from FIGS. 1 and 2 that the element 33, at the outer casing 39 of the extension 7, is extended downward beyond the aperture 40 in front of the annular chamber 21, and bears sealingly against the outer casing 39 of the extension 7 below said passage 40.

FIG. 3 illustrates a supply of hydraulic medium to the coupling piston 12 similar to that disclosed in FIGS. 1 and 2. Here, however, the element 33 runs beyond the lower edge 30 of the extension 7 and, with a radially contracted annular region 41, bears against the outer casing of the inner piston 9 below the coupling pistons 12 (in the coupled state) so as to form the annular chamber 21. It is therefore possible to dispense with the above-mentioned passage 40.

In the embodiment in FIG. 4, the axial duct 38 is again formed between the extension 7 and that section of the element 33 which bears against said extension 7 in this region. Here, the element 33, at the outer casing 39 of the extension 7, extends axially downward beyond the radially widened portion 31 and bears sealingly against said radially widened portion 31, below the passage 43 thereof, by means of a contracted collar 42. A person skilled in the art can see that the annular chamber 21 is therefore formed by the radially widened portion 31.

FIG. 5 discloses that, if a hydraulic play compensating element 48 is used, a further duct 50 (right-hand side of the figure) can be formed in the element 33, which further duct 50 can be fed with hydraulic medium from a further opening (not shown here in the drawing) in the lower region of the skirt 5. The profile of the duct 50 for conducting hydraulic medium to the hydraulic valve play compensating element 48 corresponds approximately to that of the duct 35, with the subsequent radial passage 36 and axial duct 38 for conducting hydraulic medium to a point in front of the coupling pistons 12. Here, the lower cylindrical section 47 of the inner body 9 has a radial transfer passage 54 to the play compensating element 48.

It can also be seen that, for hydraulically sealing the radial transfer passage 54 in the direction away from the cam, the element 33 bears sealingly with its lower section, which runs at the extension 7, with a contracted collar against the outer casing of the inner body 9.

FIG. 6 discloses a bucket tappet 1 according to the invention, with a play compensating element 48, which can be installed in its inner body 9 as mentioned above, but with a duct 52 for conducting the hydraulic medium extending through the annular web 24.

Provision is also made of an annular part 45, which is fitted to an underside 44 of the base-side region of the element 33, against which annular part 45 a lost motion spring 14 acts at one end, which lost motion spring is supported at the other end on an annular plate 53, which is fastened in the lower region of the lower cylindrical section 47 of the extension 7. Said annular part 45 ensures planar contact of the lost motion spring 14 against the underside 44, since the at least one radial passage 36 is formed into the element 33 in this region, as mentioned above.

LIST OF REFERENCE SYMBOLS

1 Bucket tappet
2 Base
3 Bucket basic body
4 Outer edge
5 Skirt
6 Inner edge
7 Extension
8 Bore, extension
9 Inner body
10 Underside
11 Bore, inner body
12 Coupling piston
13 Driver surface
14 Lost motion spring
15 Outer face
16 Upper side
17 Flattened portion
18 Counterpart surface
19 Inner face
20 Spring
21 Annular chamber
22 Upper end surface, inner body
23 Lower end surface, inner body
24 Annular web
25 Cylindrical section
26 Height stop element
27 Underside
28 Material recess
29 Upper side, material recess
30 Lower edge
31 Radially widened portion
32 Interior
33 Element (sheet-metal part)
34 Aperture
35 Rising duct
36 Radial passage
37 Underside
38 Axial duct
39 Outer casing, extension
40 Passage
41 Region
42 Collar
43 Passage
44 Underside

45 Annular part
46 Ventilation opening
47 Lower cylindrical section
48 Play compensating element
49 Pressure piston
50 Duct
51 Anti-twist device
52 Duct
53 Annular plate
54 Radial transfer passage

The invention claimed is:

1. A switchable bucket tappet for a valve drive of an internal combustion engine, comprising:

a bucket basic body having a ring-shaped base being guided by means of a skirt projecting from an outer edge of the ring-shaped base in a bore of the internal combustion engine, the ring-shaped base being acted on by at least one lifting cam with a hollow cylindrical extension projecting from an inner edge of the ring-shaped base, in a bore of the hollow cylindrical extension runs an inner body which is axially movable relative to the bucket basic body and which has underside with an abutment for at least indirect contact with a gas exchange valve, and at least one coupling piston running in a bore of the inner body, the coupling piston, in order to obtain a full valve lift, being placed in engagement in sections with a driver surface of the bucket basic body, and with a lost motion spring acting between the bucket basic body and the inner body, wherein a zero valve lift is obtained when the coupling piston is moved completely into the bore of the inner body, the inner body being formed without a base so as to be entirely free from contact with the cam, the coupling piston having a flattened portion on an upper side proceeding from a radially outer face, the flattened portion and the coupling piston, in a coupled state, being moved under a flat counterpart surface of the hollow cylindrical extension as a driver surface, the flat counterpart surface being situated axially below a region of the ring-shaped base of the bucket basic body, the region of the ring-shaped base being of virtually symmetrical and entirely thin-walled design, and the inner body being freely rotatably movable with respect to the bucket basic body, and wherein the inner body is of substantially hollow cylindrical design, with an annular web, in which each coupling piston is arranged, running at a distance from end surfaces of the inner body.

2. The bucket tappet of claim 1, wherein two coupling pistons are provided, situated opposite one another in the bore, which runs radially in the inner body, and each coupling piston is moved in a coupling direction by a force of at least one spring which bears against radially inner faces of each coupling piston, with a movement in a decoupling direction being effected by means of a servo medium which is conducted into an annular chamber in front of each radially outer surface of each coupling piston.

3. The bucket tappet of claim 2, wherein the coupling piston is guided in the bore of the inner body by means of an anti-twist device.

4. The bucket tappet of claim 3, wherein, as the anti-twist device, a thin-walled annular part is used which lies, so as to run concentrically with respect to an axial line of the bucket tappet, on the flattened portions of the coupling piston.

5. The bucket tappet of claim 1, wherein, in a coupled state, a cylindrical section, which runs above the annular web of the inner body, protrudes a short distance beyond the ring-shaped base of the bucket basic body with at least one radially projecting height stop element being attached to the cylindrical section, and an underside of the height stop element forms an abutment for a region of the inner edge of the ring-shaped base of the bucket base body for setting a coupling play.

6. The bucket tappet of claim 5, wherein one securing ring is provided as the height stop element, and the securing ring has a range of different thicknesses to set coupling play.

7. The bucket tappet of claim 1, wherein a material recess is provided in the hollow cylindrical extension of the bucket base body, the material recess is formed into the bore of the hollow cylindrical extension and an upper side of the material recess serves as a complementary counterpart surface for the coupling piston.

8. The bucket tappet of claim 7, wherein a thin-walled element is placed in an interior of the bucket basic body, the thin-walled element substantially follows an inner contour of the bucket basic body with at least one rising duct for hydraulic medium being formed, proceeding from at least one aperture in the skirt, between the aperture and the thin-walled element, the rising duct is connected to at least one tubular radial passage between an underside of the ring-shaped base and the thin-walled element, the radial passage being connected radially at an inside to at least one axial duct which, between an outer casing of the hollow cylindrical extension and the thin-walled element, leads away from the base to an annular chamber in front of the radially outer face of the at least one coupling piston.

9. The bucket tappet of claim 8, wherein the axial duct is connected, at its lower end, to a passage in the hollow cylindrical extension, and the passage leads to the annular chamber formed by the material recess with the thin-walled element bearing sealingly against the outer casing of the hollow cylindrical extension axially below the passage.

10. The bucket tappet of claim 8, wherein the thin-walled element, at the outer casing of the hollow cylindrical extension, extends axially beyond a lower edge of the hollow cylindrical extension and, with a radially contracted region, bears against the outer casing of the inner body below the coupling piston, with the axial duct leading, at its lower end, to the annular chamber which is delimited in a radially outward direction by the thin-walled element and which is situated axially below the lower edge and above a contracted region.

11. The bucket tappet of claim 8, wherein the thin-walled element, at the outer casing of the hollow cylindrical extension, extends axially over a radially widened portion and, in a lower region, bears sealingly by means of a contracted collar against he radially widened portion, with the annular chamber being formed by the radially widened portion, and with the axial duct communicating at a lower end, above the collar, with a passage in the radially widened portion.

12. The bucket tappet of claim 8, wherein at least one radial passage is provided in the base so as to be distributed over a periphery, the radial passage being formed, in each case, as duct-like molded portions in the thin-walled element, with an annular part as an abutment for one end of the lost motion spring running on an underside of each radial passage.

13. The bucket tappet of claim 1, within a lower edge of the hollow cylindrical extension of the bucket basic body serves as a complementary counterpart surface for the coupling piston in such a way that, in the coupled state, the coupling piston overlaps at least a thickness of the lower edge.

14. The bucket tappet of claim 1, wherein the hollow cylindrical extension of the bucket basic body has an annular radially widened portion proceeding from the bore of the hollow cylindrical extension, and an upper side of the radially widened portion serves as a complementary counterpart surface for the coupling piston.

15. The bucket tappet of claim 1, wherein a ventilation opening, which intersects the bore of the inner body for the at least one coupling piston, leads away from the bore.

16. The bucket tappet of claim 1, wherein a hydraulic play compensating element, a pressure piston, which makes contact with the gas exchange valve, is installed in a cylindrical section, which runs below the annular web of the inner body.

17. The bucket tappet of claim 16, wherein a thin-walled element is placed in an interior of the bucket basic body, the thin-walled element substantially following an inner contour of the bucket basic body, and a duct for conducting hydraulic medium to a play compensating element being formed, proceeding from at least one passage in a skirt, in the element.

* * * * *